US008105448B2

(12) United States Patent
Hallstadius et al.

(10) Patent No.: US 8,105,448 B2
(45) Date of Patent: Jan. 31, 2012

(54) FUEL BOX IN A BOILING WATER NUCLEAR REACTOR

(75) Inventors: Lars Hallstadius, Västerås (SE); Mats Dahlbäck, Västerås (SE); Magnus Limbäck, Västerås (SE); John Bates, Clearfield, UT (US); James Dougherty, Riverdale, UT (US)

(73) Assignee: Westinghouse Electric Sweden AB, Västerås (SE)

( * ) Notice: Subject to any disclaimer, the term of this patent is extended or adjusted under 35 U.S.C. 154(b) by 888 days.

(21) Appl. No.: 12/159,329

(22) PCT Filed: Jun. 22, 2005

(86) PCT No.: PCT/SE2005/001000

§ 371 (c)(1),
(2), (4) Date: Jun. 26, 2008

(87) PCT Pub. No.: WO2006/004499

PCT Pub. Date: Jan. 12, 2006

(65) Prior Publication Data

US 2009/0071579 A1 Mar. 19, 2009

Related U.S. Application Data

(60) Provisional application No. 60/585,522, filed on Jul. 6, 2004.

(30) Foreign Application Priority Data

Oct. 22, 2004 (SE) ..... 0402561

(51) Int. Cl.
*C22F 1/18* (2006.01)
*C22C 16/00* (2006.01)

(52) U.S. Cl. ..... 148/672; 148/421

(58) Field of Classification Search ..... 148/672, 148/421
See application file for complete search history.

(56) References Cited

U.S. PATENT DOCUMENTS

| | | | | |
|---|---|---|---|---|
| 3,121,034 | A * | 2/1964 | Anderko et al. | 148/672 |
| 5,223,211 | A | 6/1993 | Inagaki et al. | |
| 5,805,656 | A | 9/1998 | Adamson | |
| 5,838,753 | A * | 11/1998 | Van Swam et al. | 376/412 |
| 6,149,738 | A * | 11/2000 | Dahlback | 148/421 |
| 2001/0050968 | A1 * | 12/2001 | Nakayama et al. | 376/409 |

FOREIGN PATENT DOCUMENTS

| | | | |
|---|---|---|---|
| EP | 0198570 | A2 | 10/1986 |
| EP | 0353733 | A2 | 2/1990 |
| EP | 1225243 | A1 | 7/2002 |
| EP | 1256634 | A1 | 11/2002 |
| EP | 1 308 966 | A1 | 5/2003 |
| JP | 2001-004769 | A | 1/2001 |
| JP | 2003-149365 | | 5/2003 |

OTHER PUBLICATIONS

PCT/ISA/210—International Search Report—Oct. 4, 2005.
PCT/IPEA/409—International Preliminary Report on Patentability—Jun. 22, 2006.
Notice of Reasons for Rejection, Japanese Patent Office, Sep. 20, 2011, in connection with counterpart Japanese patent application 2007-520263.

* cited by examiner

*Primary Examiner* — Jessee R. Roe
(74) *Attorney, Agent, or Firm* — Venable LLP; Eric J. Franklin

(57) ABSTRACT

A method for manufacturing a sheet metal for use in a boiling water nuclear reactor and such a sheet metal. The method includes providing a material of a zirconium alloy that includes zirconium, and whose main alloying materials include niobium. The material is annealed so that essentially all niobium containing secondary phase particles are transformed to β-niobium particles.

14 Claims, 1 Drawing Sheet

FUEL BOX IN A BOILING WATER NUCLEAR REACTOR

CROSS-REFERENCE TO RELATED APPLICATIONS

Figure 1:
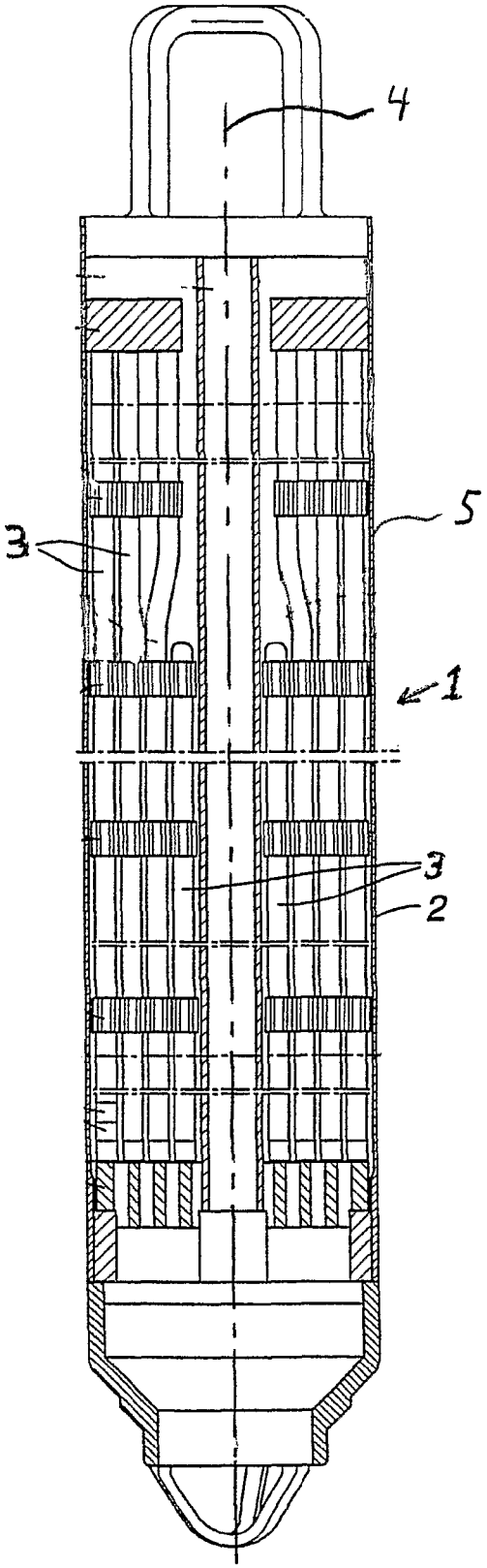

This application claims priority to U.S. provisional patent application 60/585,522 filed 6 Jul. 2004 and is the national phase under 35 U.S.C. §371 of PCT/SE2005/001000 filed 22 Jun. 2005.

TECHNICAL FIELD

The present invention relates to sheet metals in water boiling nuclear reactors and to a method for manufacturing of such sheet metals and to fuel boxes comprising such sheet metals.

DESCRIPTION OF THE PRIOR ART

In boiling water nuclear reactors the nuclear fuel is arranged in fuel pellets, which are arranged in fuel rods that in turn are arranged in a fuel box. A fuel assembly comprises the fuel box, the therein arranged fuel rods, spreader elements, and various other elements that are known to persons skilled in the art. The fuel boxes are arranged as elongated pipes with openings in the ends. The fuel boxes are manufactured from sheet metals that are bent and welded together, which sheet metals usually are comprised of a zirconium alloy. When zirconium alloys are exposed to neutron irradiation they grow. During operation of a boiling water nuclear reactor the fuel boxes are exposed to hot water and neutron irradiation, which will lead to growth and corrosion of the fuel boxes. The magnitude of this neutron induced growth is different for different alloys. When the material in the fuel box grows it may lead to the bending of the fuel box. The useful life for a fuel box in a boiling water nuclear reactor is dependent on the resistance against corrosion and the resistance against bending.

In the U.S. Pat. No. 5,805,656 a fuel box and a method for manufacturing such a fuel box are described. The problem that is intended to be solved is to provide a fuel box with better resistance against neutron induced growth and corrosion compared with prior known fuel boxes. This is solved in said U.S. patent by binding layers of different alloys in an outer layer and an inner layer in a sheet metal. The inner layer is of an alloy that has a higher resistance against irradiation growth and the outer layer has a higher resistance against corrosion.

Even if a fuel box according to the U.S. patent provides favorable resistance against neutron induced growth and favorable corrosion resistance properties it is, however, complicated to manufacture sheet metals with a plurality of layers. Thus, there is a need for an alternative to known fuel boxes, which only comprises one layer and which has at least as favorable resistance against neutron induced growth and corrosion as known sheet metals.

SUMMARY OF THE INVENTION

An object of the present invention is to provide a homogeneous sheet metal for a boiling water nuclear reactor and a method for manufacturing such a sheet metal, wherein the sheet metal, when it is exposed to neutron irradiation grows to a small extent compared with known sheet metals for boiling water nuclear reactors.

A further object of the present invention is to provide a fuel box for a boiling water nuclear reactor and a method for manufacturing such a fuel box, which fuel box has favorable resistance against corrosion and against neutron induced growth and which fuel box is manufactured of a homogeneous material.

These objects are fulfilled with a sheet metal, a fuel box, a method for manufacturing of a sheet metal and a method for manufacturing a fuel box.

A basic idea with the present invention is to provide a sheet metal which consists of a zirconium alloy, which comprises niobium containing secondary phase particles that essentially only consists of μ-niobium particles.

With secondary phase particles is in this application meant particles in the alloy which have another composition than the main part of the alloy. β-zirconium particles are particles in the zirconium alloy that contain zirconium and niobium, wherein the major part is zirconium. β-niobium particles are particles in the zirconium alloy that for the most part consist of niobium. The β-niobium particles comprise more than 90 percent by weight niobium and preferably more than 99 percent by weight niobium.

When niobium is present in a zirconium alloy, niobium containing secondary phase particles are formed, which are particles in the zirconium alloy that contain niobium or a mixture of niobium and zirconium. If niobium is present in the zirconium alloy in a sufficiently high concentration secondary phase particles in a first phase may be present as a mixture of β-zirconium particles and β-niobium particles, and in a second phase be present as only β-niobium particles. The first phase is stable at a higher temperature than the second phase. The phase boundary for secondary phase particles in the form of β-zirconium particles is the phase boundary between the first phase and the second phase. If the temperature is kept at a certain level below the temperature for the phase boundary for secondary phase particles in the form of β-zirconium particles the β-zirconium particles will be transformed into β-niobium particles.

In the description the term material is used for the object that is going through treatment steps until the material is ready-treated to a sheet metal.

According to a first aspect of the present invention a method is provided for manufacturing of a sheet metal for use in a boiling water nuclear reactor. The method comprises the step of providing a material of a zirconium alloy, which mainly consists of zirconium, wherein the main alloying materials of the alloy comprises niobium, wherein the alloy comprises niobium containing secondary phase particles and wherein no alloying material is present in a content exceeding 1.6 percent by weight. The method further comprises the steps of subjecting the material to at least one hot-rolling, subjecting the material to at least a first β-quenching, and to subject the hot-rolled material to at least one cold-rolling. The method is characterized in that it further comprises the step of, after said at least one cold-rolling and after said first β-quenching, transformation annealing the cold-rolled material, at a temperature under the phase boundary for secondary phase particles in the form of β-zirconium particles, for so long time that essentially all niobium containing secondary phase particles are transformed into β-niobium particles, which are particles in the zirconium alloy with a niobium content exceeding 90 percent by weight.

With a method according to the invention a zirconium alloy is provided, which grows only to a small extent when being exposed to neutron irradiation, and which has favorable resistance against corrosion. Naturally, other steps may be included in a method according to the invention. Furthermore, the different steps in the method according to the invention may be performed in a different order.

β-quenching is well known to persons skilled in the art and implies that the zirconium alloy is heated to a high temperature, so that a crystal structure of the type bcc (body center cubic) is obtained in the zirconium alloy, and that the zirconium alloy is then rapidly cooled so that a crystal structure of the type hcp (hexagonal closed packed) is obtained. Through this method the zirconium alloy gets a randomized structure.

The first β-quenching may be performed before the hot-rolling. If this is the case the structure in the material may be effected to some extent in the following hot-rolling and in further other following steps. Alternatively, the first β-quenching may be performed between two of said at least one hot-rolling and said at least one cold-rolling or between hot-rollings.

To obtain a randomized structure of the alloy, a second β-quenching has to be performed after the last cold-rolling.

In case the method comprises a second β-quenching at a late stage on an almost finished product it is advantageous that the method comprises a cold deformation between the second β-quenching and the transformation annealing, wherein the material is stretched so that the remaining deformation is 1%-7% of the original size before the stretching. With a cold deformation before the transformation annealing the desired result for the composition of the secondary phase particles is achieved more rapidly.

The temperature during the transformation annealing effects the rate at which β-zirconium particles are transformed into β-niobium particles. The rate is dependent partly on the rate of diffusion at which niobium diffuses in zirconium and partly on the rate of nucleation at which niobium particles are formed in zirconium. The rate of diffusion increases with temperature while the rate of nucleation decreases with temperature. The transformation annealing is performed at 450° C.-600° C., advantageously at 500° C.-600° C., and preferably at 520° C.-580° C. in order for the transformation to be rapid.

The time period during which the transformation annealing has to proceed depends on the temperature. If the temperature is kept at 500° C.-600° C., the transformation annealing is preferably performed during 6-10 hours and at least during more than or equal to 3 hours. At lower temperatures the transformation annealing has to proceed for longer time.

To achieve good properties regarding corrosion and neutron induced growth, the niobium content is preferably 0.5-1.6 percent by weight, the iron content is preferably 0.3-0.6 percent by weight and the tin content is preferably 0.5-0.85 percent by weight. The group of alloys where all three percentages are fulfilled is especially advantageous for achieving favorable properties regarding corrosion and neutron induced growth. There might also be other materials present in the alloy, the content of which, however, are below 0.05 percent by weight.

Another group of alloys with especially favorable properties is named Zirlo, in which group of alloys the tin content is 0.7-1.1 percent by weight, the iron content is 0.09-0.15 percent by weight and the niobium content is 0.8-1.2 percent by weight. There might also be other materials in the alloy, the content of which, however, are below 0.05 percent by weight.

As an alternative to the groups of alloys described above it is possible to have an alloy that essentially only comprises niobium as an alloying material, wherein the niobium content is 0.5-1.6 percent by weight and preferably 0.9-1.1 percent by weight. There might also be other materials in the alloy. The content of these other materials are, however, below 0.05 percent by weight.

Advantageously, the temperature after the transformation annealing does not exceed the temperature for the phase boundary for secondary phase particles in the form of β-zirconium particles. In case the temperature after the transformation annealing exceeds the temperature for the phase boundary for secondary phase particles in the form of β-zirconium particles, it does that for at most so long time that essentially all niobium containing secondary phase particles are maintained as β-niobium particles. In order to achieve this the temperature, after the transformation annealing, exceeds the temperature for the phase boundary for secondary phase particles in the form of β-zirconium particles, suitably for no more than 10 minutes, preferably for no more than 5 minutes and advantageously not at all. The time depends on how much the temperature is allowed to exceed the temperature for the phase boundary for β-zirconium particles.

According to a second aspect of the present invention a method is provided for manufacturing a fuel box for a boiling water nuclear reactor, wherein a sheet metal is manufactured, and wherein the sheet metal is arranged as at least one of the walls of the fuel box.

According to a third aspect of the present invention a sheet metal is provided for use in a boiling water nuclear reactor, which sheet metal is comprised of a zirconium alloy which mainly consists of zirconium, wherein the main alloying materials of the alloy comprises niobium, wherein no alloying material is present in a content in excess of 1.6 percent by weight and wherein the alloy comprises niobium containing secondary phase particles. The sheet metal is characterized in that the niobium containing secondary phase particles essentially only consists of β-niobium particles, which are particles in the zirconium alloy with a niobium content that exceeds 90 percent by weight and preferably exceeds 99 percent by weight.

The sheet metal has the advantages that have been described above in relation to the method according to the present invention. The sheet metal may of course be manufactured with a method as described above.

According to a fourth aspect of the present invention a fuel box is provided, which comprises a sheet metal according to the invention arranged as at least one of the walls of the fuel box.

The features that have been described in relation to the method above may, where it is applicable, also be applied to a sheet metal and a fuel box according to the invention.

It goes without saying that the different features that have been described above, may be combined in the same embodiment where it is applicable. In the following different embodiments of the invention will be described with reference to the accompanying drawings.

SHORT DESCRIPTION OF THE DRAWING

FIG. 1 shows a fuel assembly including a fuel box according to an embodiment of the present invention.

DESCRIPTION OF PREFERRED EMBODIMENTS

FIG. 1 shows a fuel assembly 1 according to the prior art, which is arranged for a boiling water nuclear reactor. The fuel assembly 1 comprises a fuel box 2 according to an embodiment of the present invention. The fuel assembly also comprises fuel rods 3 in which the nuclear fuel is arranged in fuel pellets. The fuel box 2 has a length axis 4 which is parallel to the length axis of the fuel rods 3. The fuel box 2 is usually manufactured of two sheet metals 5 which are bent and welded together along the direction of the length axis 4 of the fuel box 2.

Below two examples are given on manufacturing methods according to the invention for a sheet metal 5 for a fuel box 2.

Common for the methods is that a transformation annealing is performed at a late stage in order to transform the secondary phase particles in the form of β-zirconium particles into secondary phase particles in the form of β-niobium particles. The annealing is performed at a temperature that is below the temperature for the phase boundary for β-zirconium particles, which is at approximately 610° C. The driving force for the transformation of secondary phase particles from β-zirconium particles to β-niobium particles is partly limited by the diffusion rate for niobium in zirconium and partly limited by the nucleation rate, which is the rate at which secondary phase particles are formed in the alloy. The diffusion increases with an increasing temperature while the nucleation rate decreases with an increasing temperature. This implies that there is an optimal temperature for a high transformation rate.

For the alloys that are contemplated in this application the optimal temperature for a rapid transformation is approximately 550° C. However, it is possible to achieve the desired result as long as the temperature is below the temperature for the phase boundary for β-zirconium particles. A preferred interval is 500-600° C. and an even more preferred interval is 540-580° C.

The alloys that primarily are interesting for the invention are the ones that have a niobium content of 0.5-1.6 percent by weight.

A first group of alloys are the ones that have the niobium content mentioned above, an iron content of 0.3-0.6 percent by weight and a tin content of 0.5-0.85 percent by weight. There may also be other materials in the alloy. The content of these other materials is, however, below 0.05 percent by weight.

A second group of alloys is Zirlo that has 0.7-1.1 percent by weight tin, 0.09-0.15 percent by weight iron, 0.8-1.2 percent by weight niobium. There might also be other materials in the alloy, the content of which, however, is below 0.05 percent by weight.

A third group of alloys comprises as a main alloying material only niobium, wherein the niobium content is 0.9-1.1 percent by weight. There might also be other materials in the alloy, the content of which, however, is below 0.05 percent by weight.

All these groups of alloys provides favorable resistance against corrosion and little neutron induced growth.

Example 1

When manufacturing the sheet metal 5 in the fuel box 2 according to a first example, firstly an electrode of a zirconium alloy is manufactured, which comprises approximately 1 percent by weight of niobium, 0.4 percent by weight of iron and 0.6 percent by weight of tin based on the weight of the electrode, by pressing together zirconium briquettes together with alloying materials. Thereafter, the electrode is vacuum melted to a casting which thereafter is vacuum melted at least once, whereupon the casting is forged to a material which is 100-125 mm thick, which in turn is worked and surface conditioned. Thereafter the material is subject to β-quenching, which implies that the material is heated to a temperature of 1000° C.-1100° C. and thereafter is cooled. The material is cooled at a rate of at least 10° C. per second to a temperature below 500° C. After the β-quenching the material is surface conditioned and is then hot-rolled in several steps. The number of steps and the thicknesses after each hot-rolling depends on the final thickness that is desired on the sheet metal 5.

The material is subject to a number of cold-rollings. By subjecting the hot-rolled material to annealing before the first cold-rolling a favorable grain structure is obtained in the material. Between each one of the cold-rollings the material is annealed in order to restore the grain structure before the next cold-rolling, according to standard manufacturing procedures. Annealing is performed at a temperature below the temperature at β-quenching, i.e., below 900° C. and preferably below approximately 600° C., for example at approximately 560° C.

After the cold-rollings a transformation annealing is performed by heating the material to a temperature of 545° C. for six hours. During the transformation annealing secondary phase particles in the form of β-zirconium particles are transformed into secondary phase particles in the form of β-niobium particles, which consist of particles with a niobium content that exceeds 99 percent by weight.

After the transformation annealing the material is cold-rolled to a finished dimension and is finish annealed in order to restore the grain structure. The finish annealing is performed at a temperature that is below the temperature for the phase boundary for β-zirconium particles. The finished sheet metal has thereby been manufactured. Finally, the edges of the sheet metal 5 are cut, which sheet metal is also surface conditioned.

Example 2

When manufacturing the sheet metal 5 in the fuel box 2 according to a second example, an electrode of a zirconium alloy is manufactured, which comprises 0.97 percent by weight of tin, 0.01 percent by weight of iron, 1.03 percent by weight of niobium, and 0.0081 percent by weight of chromium, by pressing together zirconium briquettes together with the alloying materials. This alloy is also known under the name Zirlo. Thereafter, the electrode is vacuum melted to a casting which thereafter is vacuum re-melted at least once, whereupon the casting is forged to a material which is 100-125 mm thick, which in turn is worked and surface conditioned. Thereafter the material is subject to β-quenching, which implies that the material is heated to a temperature of 1000° C.-1100° C. and thereafter is cooled rapidly. The material is cooled at a rate of at least 10° C. per second to a temperature below 500° C. Then the material is hot-rolled in several steps. The number of steps and the thicknesses after each hot-rolling depends on the final thickness that is desired on the sheet metal 5.

By subjecting the hot-rolled material to annealing before the first cold-rolling a favorable grain structure is obtained in the material. The material is subject to a number of cold rollings. Between each one of the cold-rollings the material is annealed in order to restore the grain structure before the next cold-rolling, according to standard manufacturing procedures. Annealing is performed at a temperature below the temperature at β-quenching, i.e. below 900° C. and preferably below approximately 600° C., for example at approximately 560° C.

Thereafter the material is subject to a second β-quenching, which implies that the material is heated to a temperature of 1000° C.-1100° C. and is then cooled rapidly. The material is cooled at a rate of at least 10° C. per second to a temperature below 500° C.

After the second β-quenching a cold deformation is performed, wherein the material is stretched so that the remaining deformation is 3% of the original size before stretching. Thereafter a transformation annealing is performed by heating the material to a temperature of 545° C. during six hours.

During the transformation annealing secondary phase particles of β-zirconium particles are transformed to secondary phase particles in the form of β-niobium particles, which consist of particles with a niobium content that exceeds 99 percent by weight. The finished sheet metal 5 has thus been manufactured. Finally, the edges of the sheet metal 5 are cut, which sheet metal is also surface conditioned.

After manufacturing the sheet metal according to any one of the above examples a fuel box 2 is manufactured by bending two sheet metals 5 and welding them together to a fuel box 2. The way a fuel box 2 is manufactured from sheet metals 5 is known from the art and will not be described in detail here.

Naturally, the invention is not limited to the embodiments described above but may be modified in numerous ways without departing from the scope of the present invention, which is limited only by the appended claims.

It is possible to include also other alloying materials than the ones that have been mentioned above in concentrations below the concentrations of the alloying materials mentioned above.

Naturally, it is possible to exchange the alloying materials for each other in de embodiments described above or to replace them with an alloy comprising only niobium as an alloying material.

The invention claimed is:

1. A method for manufacturing of a sheet metal for use in a boiling water nuclear reactor, the method comprising:

providing a material of a zirconium alloy, comprising zirconium, wherein the main alloying materials of the alloy comprises niobium, wherein no alloying material is present in a content exceeding 1.6 percent by weight and wherein the alloy comprises niobium containing secondary phase particles, subjecting the material to at least one hot-rolling, subjecting the material to at least a first β-quenching, subjecting the hot-rolled material to at least one cold-rolling, and, after said at least one cold-rolling and after said first β-quenching, transformation annealing the cold-rolled material, at a temperature below the phase boundary for secondary phase particles in the form of β-zirconium particles, for so long time that essentially all niobium containing secondary phase particles are transformed into β-niobium particles, which are particles in the zirconium alloy with a niobium content exceeding 90 percent by weight, wherein the main alloying materials are niobium, iron and tin, wherein the tin content is 0.7-1.1 percent by weight, the iron content is 0.09-0.15 percent by weight, and the niobium content is 0.8-1.2 percent by weight.

2. The method according to claim 1, wherein the first β-quenching is performed before the hot-rolling.

3. The method according to claim 1, wherein the first β-quenching is performed between one of said at least one hot-rolling and said at least one cold-rolling.

4. The method according to claim 1, further comprising:

arranging the sheet metal as at least one of a fuel box.

5. The method according to claim 1, further comprising:

a second β-quenching, which is performed after said at least one cold rolling and before the transformation annealing.

6. The method according to claim 5, further comprising:

a cold deformation between the second β-quenching and the transformation annealing, wherein the material during the cold deformation is stretched so that the remaining deformation is 1%-7% of the original size before the stretching.

7. The method according to claim 1, wherein the transformation annealing is performed at 450° C.-600° C.

8. The method according to claim 7, wherein the transformation annealing is performed at 500° C.-600° C.

9. The method according to claim 7, wherein the transformation annealing is performed at 540° C.-580° C.

10. The method according to claim 1, wherein the temperature, in case it after the transformation annealing exceeds the temperature for the phase boundary for secondary phase particles in the form of β-zirconium particles, does it for at most so long time that essentially all niobium containing secondary phase particles are maintained as β-niobium particles.

11. The method according to claim 10, wherein the temperature after the transformation annealing exceeds the temperature for the phase boundary for secondary phase particles in the form of β-zirconium particles for no longer than 10 minutes.

12. The method according to claim 11, wherein the temperature after the transformation annealing exceeds the temperature for the phase boundary for secondary phase particles in the form of 13-zirconium particles for no longer than 5 minutes.

13. The method according to claim 11, wherein the temperature after the transformation annealing does not exceed the temperature for the phase boundary for secondary phase particles in the form of β-zirconium particles.

14. A method for manufacturing of a sheet metal for use in a boiling water nuclear reactor, the method comprising:

providing a material of a zirconium alloy, comprising zirconium, wherein the main alloying materials of the alloy comprises niobium, wherein no alloying material is present in a content exceeding 1.6 percent by weight and wherein the alloy comprises niobium containing secondary phase particles, subjecting the material to at least one hot-rolling, subjecting the material to at least a first β-quenching, subjecting the hot-rolled material to at least one cold-rolling, and after said at least one cold-rolling and after said first β-quenching, transformation annealing the cold-rolled material, at a temperature below the phase boundary for secondary phase particles in the form of β-zirconium particles, for so long time that essentially all niobium containing secondary phase particles are transformed into β-niobium particles, which are particles in the zirconium alloy with a niobium content exceeding 90 percent by weight, wherein the main alloying materials are niobium, iron and tin, wherein the niobium content is 0.5-1.6 percent by weight, the iron content is 0.3-0.6 percent by weight, and the tin content is 0.5-0.85 percent by weight.

* * * * *